US007836798B2

(12) United States Patent
Hu

(10) Patent No.: US 7,836,798 B2
(45) Date of Patent: Nov. 23, 2010

(54) RATCHET WRENCH WITH THREE OPERATIONAL POSITIONS

(76) Inventor: Bobby Hu, 16F-2, No. 367, Gongg Yi Road, West District, Taichung (TW)

( * ) Notice: Subject to any disclaimer, the term of this patent is extended or adjusted under 35 U.S.C. 154(b) by 128 days.

(21) Appl. No.: 12/355,765

(22) Filed: Jan. 17, 2009

(65) Prior Publication Data

US 2010/0000376 A1 Jan. 7, 2010

(30) Foreign Application Priority Data

Jul. 4, 2008 (TW) ..... 97125323 A

(51) Int. Cl.
*B25B 13/46* (2006.01)

(52) U.S. Cl. ..... 81/63.1

(58) Field of Classification Search ..... 81/61–63.2
See application file for complete search history.

(56) References Cited

U.S. PATENT DOCUMENTS 7,210,380 B1 * 5/2007 Wu ..... 81/63.2
7,278,339 B2 10/2007 Hu ..... 81/63.2
7,299,720 B1 * 11/2007 Schultz et al. ..... 81/63.1
7,313,987 B1 * 1/2008 Chen et al. ..... 81/63.1
2008/0229887 A1 * 9/2008 Thompson et al. ..... 81/62
2008/0229889 A1 * 9/2008 Hopper et al. ..... 81/63.1

* cited by examiner

*Primary Examiner*—David B Thomas
(74) *Attorney, Agent, or Firm*—Alan Kamrath; Kamrath & Associates PA

(57) ABSTRACT

A ratchet wrench includes a head rotatably receiving a drive member and slideably receiving two pawls each having a coupling portion. An elastic element is mounted between the pawls to bias the pawls to engage with a coupling section of the drive member. A ring is received in the head and pivotably mounted around an engaging portion of the drive member about a pivot axis. A reversing plate is pivotably mounted around a portion of the engaging portion of the drive member beyond the head about the pivot axis between first, second, and third operative positions. The reversing plate is connected to the ring to allow joint pivotal movement about the pivot axis. The ring includes a tail having two actuating portions respectively and releasably engaging with the coupling portions of the pawls responsive to movement of the reversing plate between the three operative positions.

6 Claims, 9 Drawing Sheets

RATCHET WRENCH WITH THREE OPERATIONAL POSITIONS

BACKGROUND OF THE INVENTION

The present invention relates to a ratchet wrench and, more particularly, to a ratchet wrench with three operational positions.

U.S. Pat. No. 7,278,339 discloses a reversible ratchet wrench including a head rotatably receiving a drive member. A pawl is slideably received in the head between two positions and releasably engages with the drive member. A ring is mounted around an end of the drive member and includes a tip piece having a slot. A reversing plate is pivotably mounted to the end of the drive member and operatively connected to the ring to turn therewith. A switching member is pivotably received in a receiving hole of the head and includes a protrusion engaged in the slot of the tip piece of the ring such that the switching member is pivoted when the ring is pivoted. The switching member includes a receptacle receiving an elastic element and a pressing member biased by the elastic element to press against the pawl. The reversing plate is pivotable between two operative positions to move the pawl between the two positions to switch the driving direction of the ratchet wrench. However, the pivotal axis of the ring coaxial with the rotating axis of the drive member is not coaxial to the pivotal axis of the switching member that is coaxial with the receiving hole. Thus, movement between the ring and the switching member for switching the driving direction of the ratchet wrench is complicated, and the driving direction-switching operation may be unreliable. Furthermore, movement of the protrusion of the switching member for moving the pressing member must compress the elastic member to avoid interference with movement of the pawl. As a result, the driving direction-switching operation may not be smooth. Further, a large number of components are required. Further, the switching member would require an additional space in the head when a third operational position is needed, leading to limitation of designs of the ratchet wrench.

Thus, a need exists for a ratchet wrench with three operational positions having fewer components while allowing smooth, reliable driving direction-switching operation.

BRIEF SUMMARY OF THE INVENTION

The present invention solves this need and other problems in the field of reliable direction switching operation of ratchet wrenches by providing, in a preferred form, a ratchet wrench including a head and a handle interconnected to the head. The head includes a first side and a second side spaced from the first side. The head further includes a compartment defined between the first and second sides. The compartment includes a first compartment section and a second compartment section. The first side has an opening in communication with the compartment. A drive member is rotatably received in the first compartment section and includes a coupling section at an intermediate portion thereof. An engaging portion extends from an end of the coupling section and has a portion beyond the head through the opening. A drive column extends from the other end of the coupling section beyond the head through the second side. A first pawl and a second pawl are slideably received in the second compartment section. Each pawl includes a toothed face releasably engaged with the coupling section of the drive member. An elastic element is mounted between the pawls to bias the pawls away from each other to engage the toothed faces of the pawls with the coupling section of the drive member. The first pawl includes a first coupling portion, and the second pawl includes a second coupling portion. A ring is received in the compartment and pivotably mounted around the engaging portion of the drive member about a pivot axis. The ring includes a tail extending toward the second compartment section. The tail includes first and second actuating portions respectively and releasably engaged with the first and second coupling portions of the pawls. A reversing plate is pivotably mounted around the portion of the engaging portion beyond the head between first, second, and third operative positions about the pivot axis. The reversing plate includes a thumb piece for manually pivoting the reversing plate. A retaining device is received in the thumb piece and retains the reversing plate in one of the first, second, and third operative positions while allowing movement of the reversing plate between the first, second, and third positions.

When the reversing plate is in the first operative position, the toothed face of the second pawl is engaged with the coupling section of the drive member, the first actuating portion of the ring is engaged with the first coupling portion of the first pawl to disengage the toothed face of the first pawl from the coupling section of the drive member, allowing the handle and the drive member to rotate in a first direction driving a fastener in the first direction, and allowing the handle to rotate freely relative to the drive member in a second direction reverse to the first direction without driving the fastener.

When the reversing plate is in the second operative position, the toothed face of the first pawl is engaged with the coupling section of the drive member, the second actuating portion of the ring is engaged with the second coupling portion of the second pawl to disengage the toothed face of the second pawl from the coupling section of the drive member, allowing the handle and the drive member to rotate in the second direction driving the fastener in the second direction, and allowing the handle to rotate freely relative to the drive member in the first direction without driving the fastener.

When the reversing plate is in the third operative position, the toothed face of each of pawl is engaged with the coupling section of the drive member, allowing the handle and the drive member to rotate in either of the first and second directions driving the fastener, and not allowing free rotation of the handle relative to the drive member in either of the first and second directions without driving the fastener.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

Figure 1:
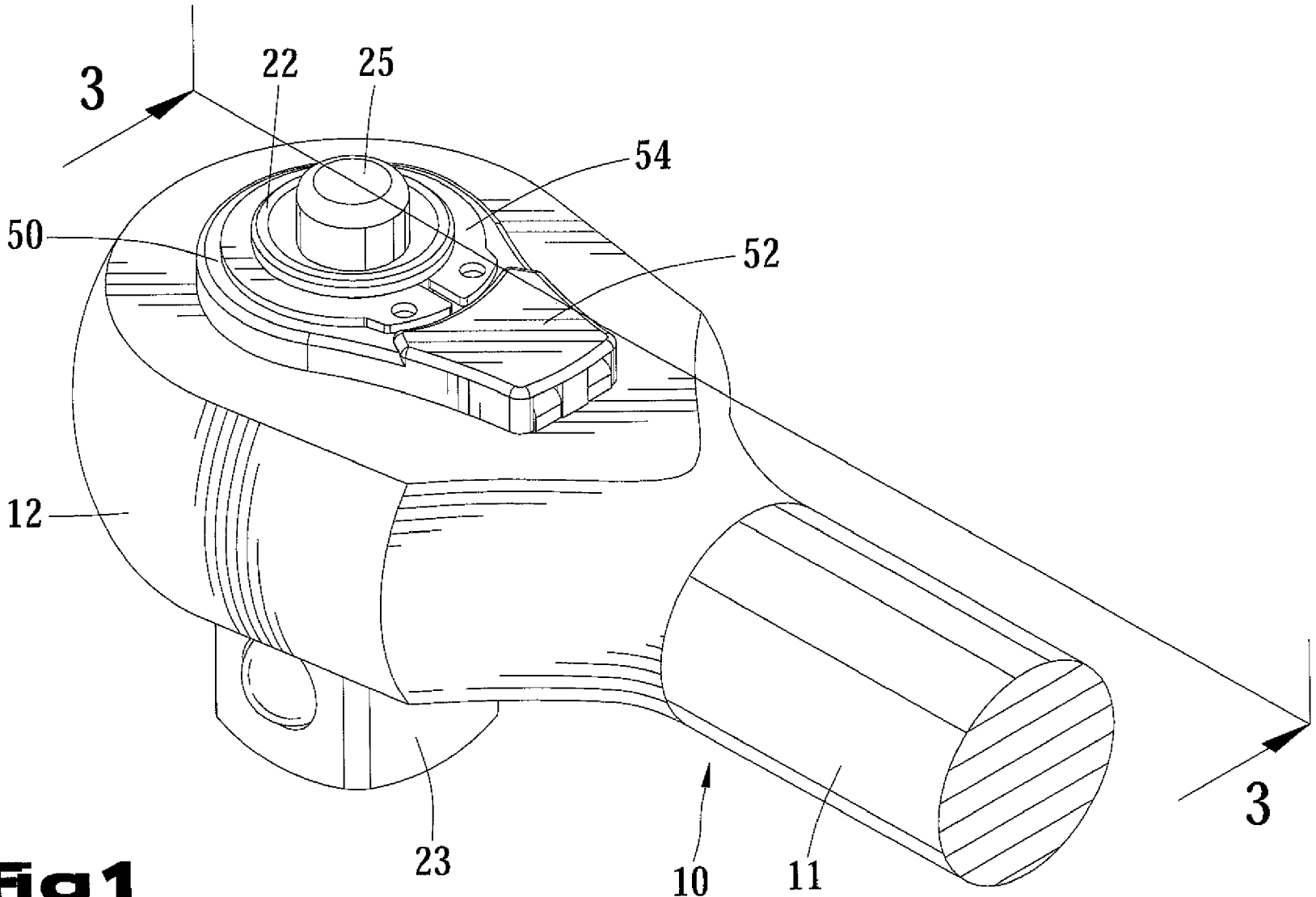
FIG. 1 shows a partial, perspective view of a ratchet wrench according to the preferred teachings of the present invention.
Figure 2:
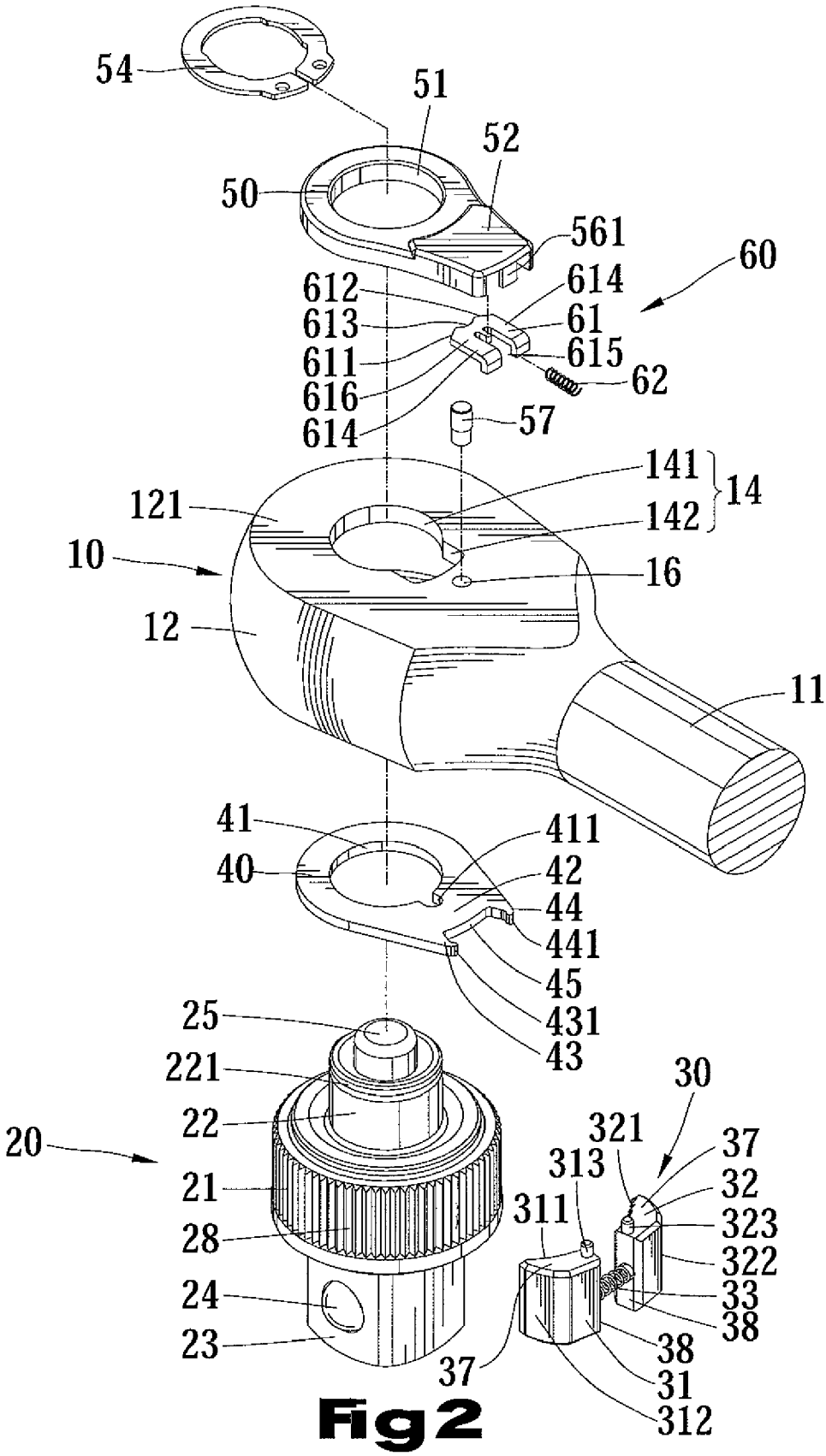
FIG. 2 shows an exploded, perspective view of the ratchet wrench of FIG. 1.
Figure 3:
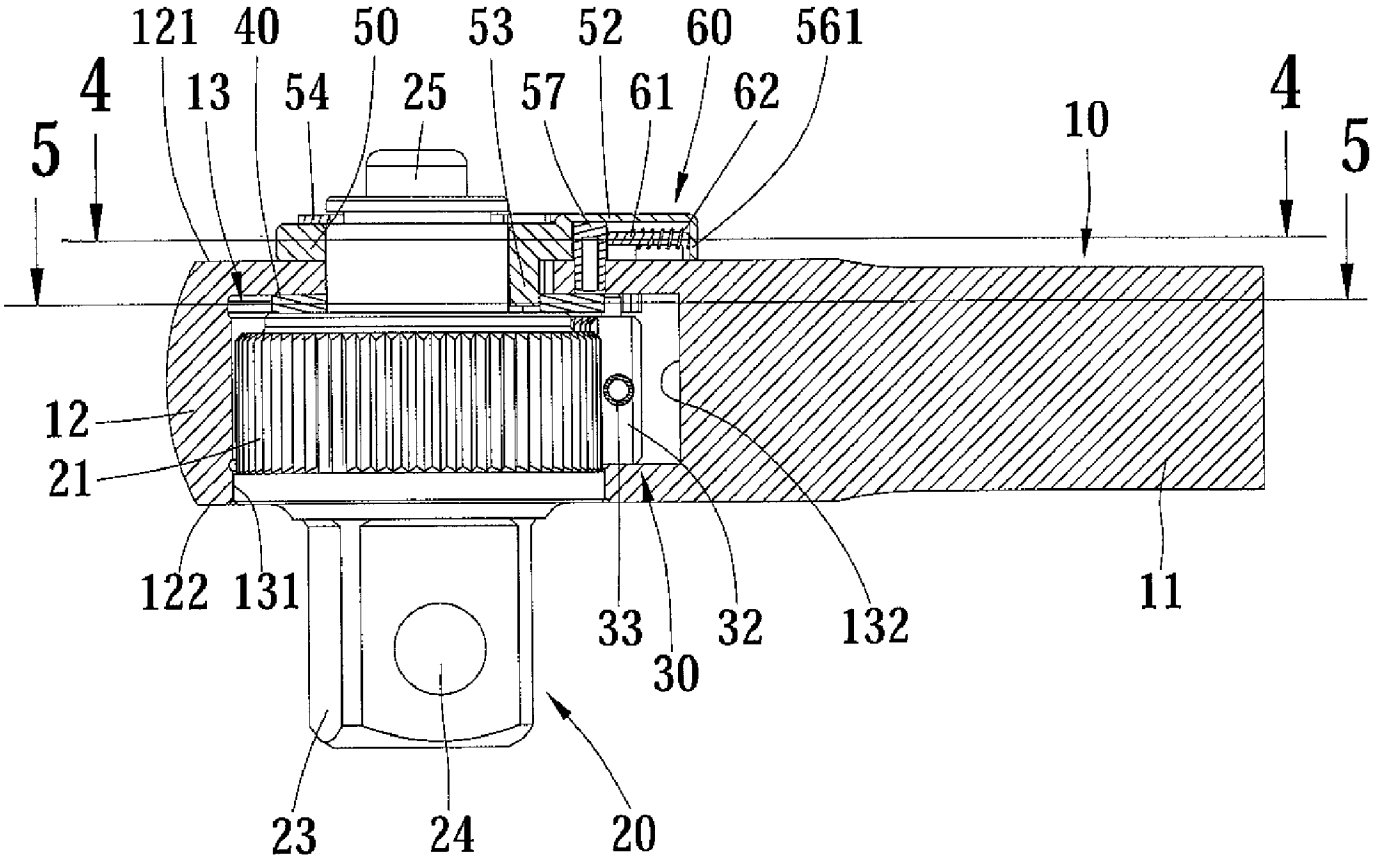
FIG. 3 shows a partial, cross sectional view of the ratchet wrench of FIG. 1 according to section line 3-3 of FIG. 1.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "third", "inner", "outer", "side", "end", "portion", "section", "downward", "annular", "circumferential", "clockwise", "counterclockwise", "thickness", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

A ratchet wrench according to the preferred teachings of the present invention is shown in the drawings and generally designated 10. According to the preferred form shown, ratchet wrench 10 includes a handle 11 and a head 12 interconnected to handle 11. Head 12 includes a first side 121 and a second side 122 spaced from first side 121 in a thickness direction. A compartment 13 is defined between first and second sides 121 and 122. In the most preferred form shown, compartment 13 includes a larger, first opening section 131 that has a longitudinal axis extending in the thickness direction and that is circular in cross section. Compartment 13 further includes a smaller, second opening section 132 defined in an inner periphery of first opening section 131. Second opening section 132 is crescent in cross section. First side 121 includes an opening 14 in communication with first compartment section 131. Opening 14 includes a first opening section 141 that is circular in cross section and coaxial with the longitudinal axis of first compartment section 131. Opening 14 further includes a second opening section 142 extending toward handle 11. Second opening section 142 is substantially rectangular in cross section. First side 121 further includes a pin hole 16 adjacent to second opening section 142.

According to the preferred form shown, a drive member 20 is rotatably received in first compartment section 131 of head 12 about a rotating axis coaxial with the longitudinal axis of first compartment section 131. Drive member 20 includes a coupling section 21 at an intermediate portion thereof. Coupling section 21 includes a plurality of teeth 28 in an outer periphery thereof. An engaging portion 22 extends from an end of coupling section 21 beyond head 12 through first opening section 141 and includes an annular groove 221 in an outer circumference thereof. A drive column 23 extends from the other end of coupling section 21 beyond head 12 through second side 122. In the most preferred form shown, drive column 23 includes a hole receiving a ball 24. Drive member 20 further includes a central through-hole extending from engaging portion 22 through drive column 23 and in communication with the hole of drive column 23. A pushpin 25 is extended through the central through-hole and can be pushed to allow movement of ball 24 in the hole of drive column 23 for disengaging drive column 23 from a socket.

According to the preferred form shown, first and second pawls 31 and 32 are slideably received in second compartment section 132 of head 12. Each of first and second pawls 31, 32 includes an inner, toothed face 311, 321 releasably engaged with teeth 28 of drive member 20. Each of first and second pawls 31 and 32 further includes a top face 37 transverse to toothed face 311, 321. A first coupling portion 313 in the most preferred form shown as a peg is formed on an inner end of top face 37 of first pawl 31. A second coupling portion 323 in the most preferred form shown as a peg is formed on an inner end of top face 37 of second pawl 32. Each of first and second pawls 31 and 32 further includes an outer face 312, 322 opposite to the toothed face 311, 321. Outer face 312, 322 of each of first and second pawls 31 and 32 slideably abuts a peripheral wall of second compartment section 132 acing first compartment section 131. Each of first and second pawls 31 and 32 further includes an end face 38 transverse to top face 37 and to toothed face 311, 321. An elastic element 33 in the most preferred form shown as a spring is mounted between end faces 38 of first and second pawls 31 and 32. Elastic element 33 biases first and second pawls 31 and 32 away from each other to engage toothed faces 311 and 321 of first and second pawls 31 and 32 with teeth 28 of drive member 20.

According to the preferred form shown, a ring 40 is received in compartment 13 of head 12. Ring 40 includes a pivotal hole 41 allowing ring 40 to be pivotably mounted around engaging portion 22 of drive member 20 about a pivot axis coaxial with the rotating axis of drive member 20. Pivotal hole 41 includes an inner periphery having a notch 411. A tail 42 projects outward from ring 40 toward second compartment section 132. In the most preferred form shown, tail 42 includes first and second actuating portions 43 and 44 defining a space 45 therebetween. First actuating portion 43 includes a first hooked portion 431 at a distal end thereof distant to the pivot axis of ring 40. First hooked portion 431 extends toward second actuating portion 44. Second actuating portion 44 includes a second hooked portion 441 at a distal end thereof distant to the pivot axis of ring 40. Second hooked portion 441 extends toward first actuating portion 43. Ring 40 can be pivoted in a direction to engage first actuating portion 43 with first coupling portion 313 of first pawl 31 for disengaging toothed face 311 of first pawl 31 from teeth 28 of coupling section 21 of drive member 20. Also, ring 41 can be pivoted in a reverse direction to engage second actuating portion 44 with second coupling portion 323 of second pawl 32 for disengaging toothed face 321 of second pawl 32 from teeth 28 of coupling section 21 of drive member 20. First and second coupling portions 313 and 323 of first and second pawls 31 and 32 are movably received in space 45 and restrained by hooked portions 431 and 441 to reliably retain first and second pawls 31 and 32 in place.

According to the preferred form shown, ratchet wrench 10 further includes a reversing plate 50 having a hole 51 so as to be pivotably mounted around a portion of engaging portion 22 of drive member 20 beyond head 12. Reversing plate 50 is pivotable between first, second, and third operative positions about a pivot axis coaxial with the rotating axis of drive member 20. Reversing plate 50 further includes a positioning peg 53 extending downward from an inner side thereof toward head 12. Positioning peg 53 extends through second opening section 142 into notch 411 of ring 41, so that reversing plate 50 and ring 40 pivot jointly about the same pivot axis. In the most preferred form shown, reversing plate 50 is pivotably mounted around engaging portion 22 of drive member 20 by a retainer ring 54 engaged in annular groove 221 of engaging portion 22 beyond first side 121 of head 12. Reversing plate 50 further includes a thumb piece 52 extending outward from an outer periphery thereof. Thumb piece 52 includes an underside having an arcuate groove 55 extending in a circumferential direction about the pivot axis of reversing plate 50. The underside of thumb piece 52 further includes a receiving space 56 in communication with arcuate groove 55. Receiving space 56 includes a rear opening. Thumb piece 52 has a tab 561 extending into the rear opening.

According to the preferred form shown, a pin 57 is received in arcuate groove 55 and engaged in pin hole 16 of first side 121 of head 12. Thus, reversing plate 50 is pivotable relative to pin 57, and arcuate groove 55 slideably receives pin 57.

According to the preferred form shown, a retaining device 60 is mounted in receiving space 56 of thumb piece 52 and includes a substantially U-shaped slide piece 61 and an elastic member 62. Specifically, slide piece 61 has U-shaped cross sections and includes two limbs 614 extending in a direction parallel to a longitudinal axis of slide piece 61 and defining a space 615 therebetween. Slide piece 61 further includes an intermediate section 616 interconnected between limbs 614 and extending in a transverse direction to the longitudinal axis of slide piece 614. Intermediate section 616 of slide piece 61 includes an outer side facing arcuate groove 55 and having first, second, and third push faces 611, 612, and 613. In the most preferred form shown, intermediate section 616 further includes an inner side delimiting space 615. Slide piece 61 is slideably received in receiving space 56 and extends into arcuate groove 55. Elastic member 62 is received in space 615 between limbs 614. Furthermore, elastic member 62 includes an end which abuts against tab 561 of receiving space 56. The other end of elastic member 62 abuts against the inner side of intermediate section 616 between limbs 614. In the most preferred form shown, third push face 613 is intermediate first and second faces 611 and 612 and in the form of an arcuate face defining a groove. Each of first and second faces 611 and 612 is a slant at acute angle with the longitudinal axis of slide piece 61.

Figure 4:
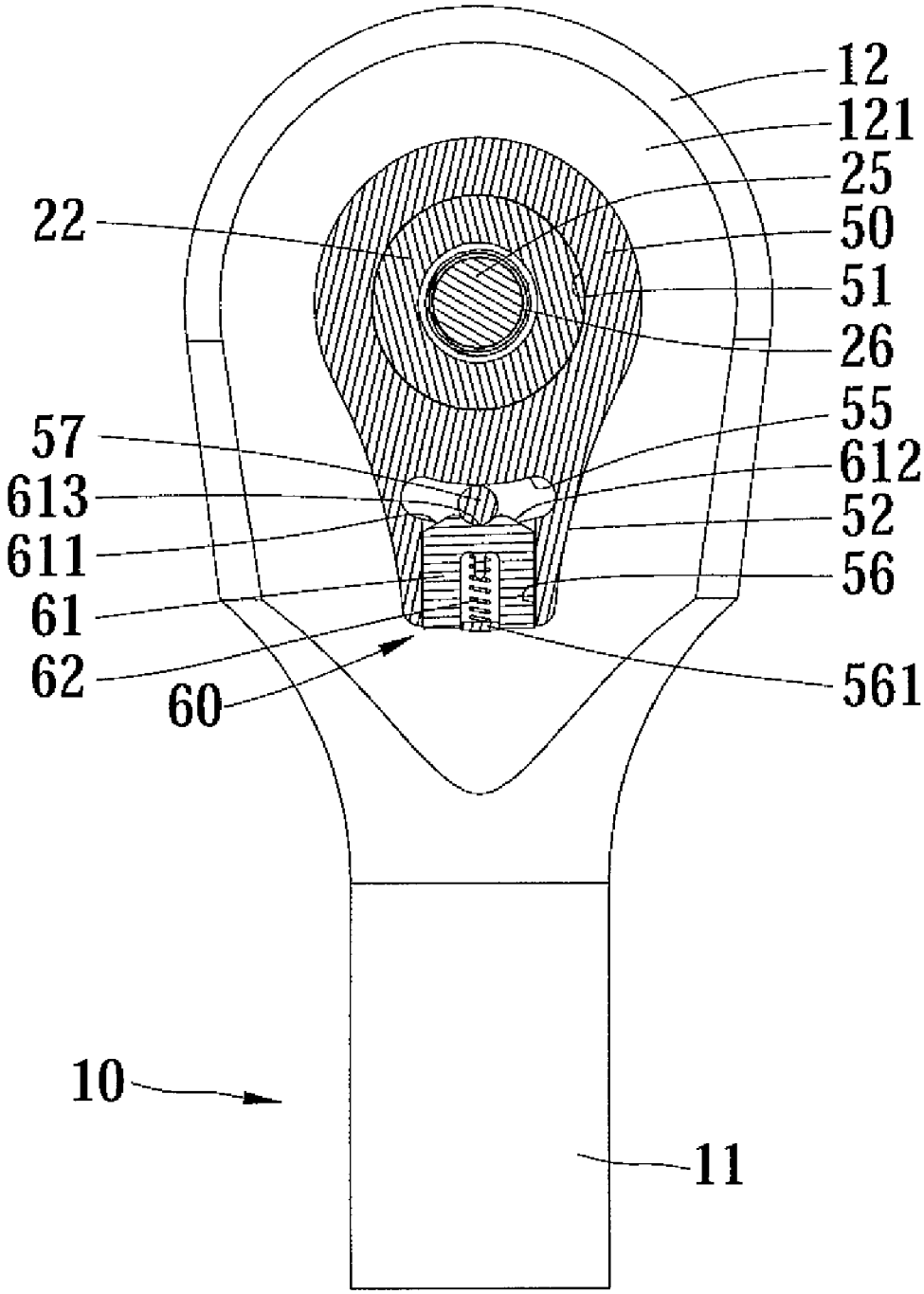
FIG. 4 shows a partial, cross sectional view of the ratchet wrench of FIG. 1 according to section line 4-4 of FIG. 3 with a reversing plate of the ratchet wrench in a third operative position.
Figure 5:
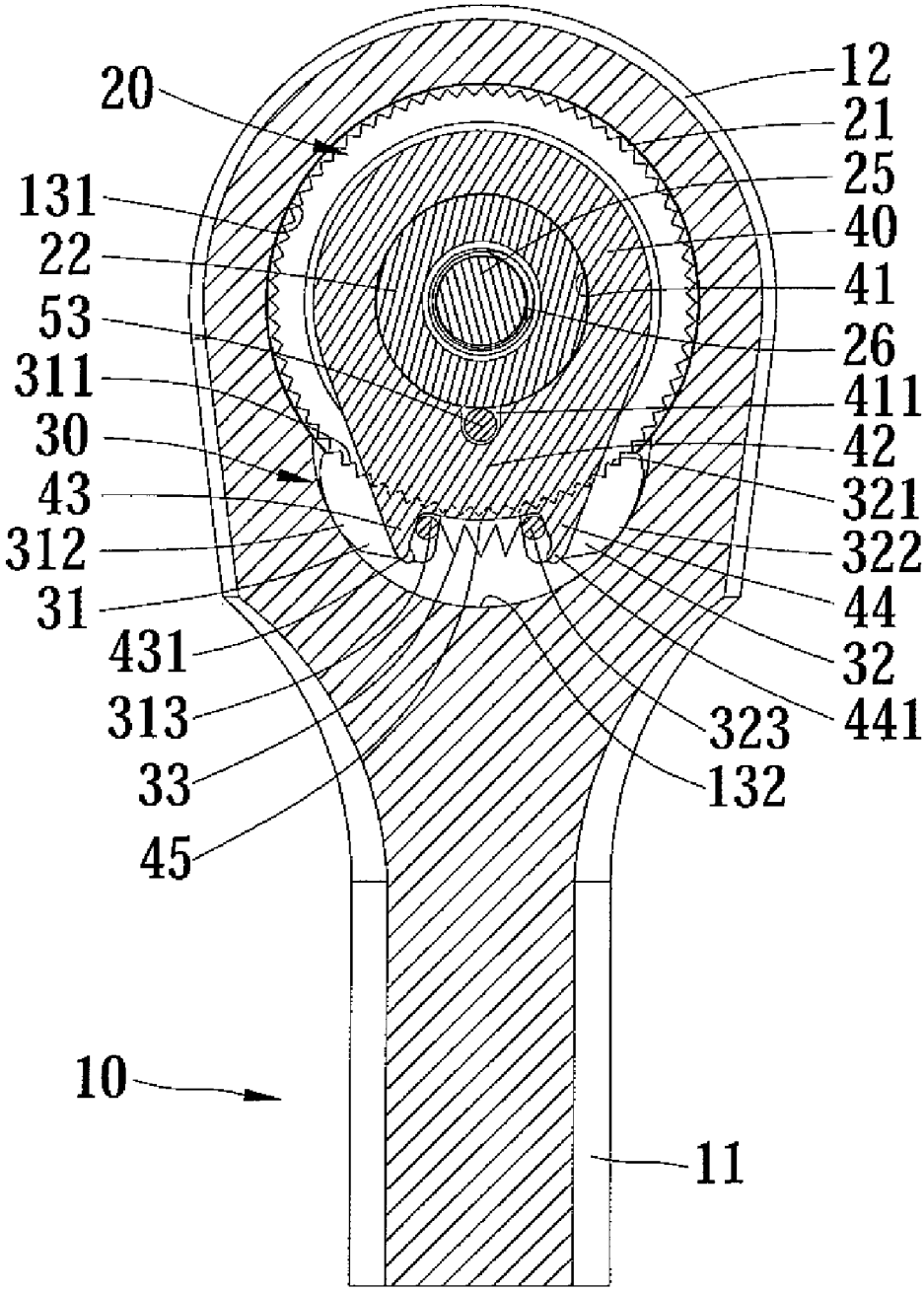
FIG. 5 shows a partial, cross sectional view of the ratchet wrench of FIG. 1 according to section line 5-5 of FIG. 3 with the ratchet wrench capable of driving a fastener in either of a clockwise direction and a counterclockwise direction.

Now that the basic construction of ratchet wrench 10 of the preferred teachings of the present invention has been explained, the operation and some of the advantages of ratchet wrench 10 can be set forth and appreciated. In particular, for the sake of explanation, it will be assumed that reversing plate 50 is in the third operative position (FIGS. 4 and 5). Slide piece 61 is biased by elastic member 62 toward pin 57. Note that pin 57 is received in the groove defined by third push face 613. Furthermore, third push face 613 presses against pin 57 to reliably retain reversing plate 50 in place. Since positioning peg 53 of reversing plate 50 is securely engaged in notch 411 of ring 40, ring 40 is also retained in place. Furthermore, first and second coupling portions 313 and 323 of first and second pawls 31 and 32 are received in space 45 and disengaged from first and second hooked portions 431 and 441. Further, toothed faces 311 and 321 of first and second pawls 31 and 32 are engaged with teeth 28 of drive member 20, so that handle 11 and drive member 20 can not rotate relative to head 12. Thus, handle 11 and drive member 20 can rotate in either clockwise or counterclockwise direction to drive a fastener in the same direction. Free rotation of handle 11 relative to drive member 20 without driving the fastener is not allowed. Thus, slight tightness adjustment of the fastener is allowed when reversing plate 50 is in the third operative position.

Figure 6:
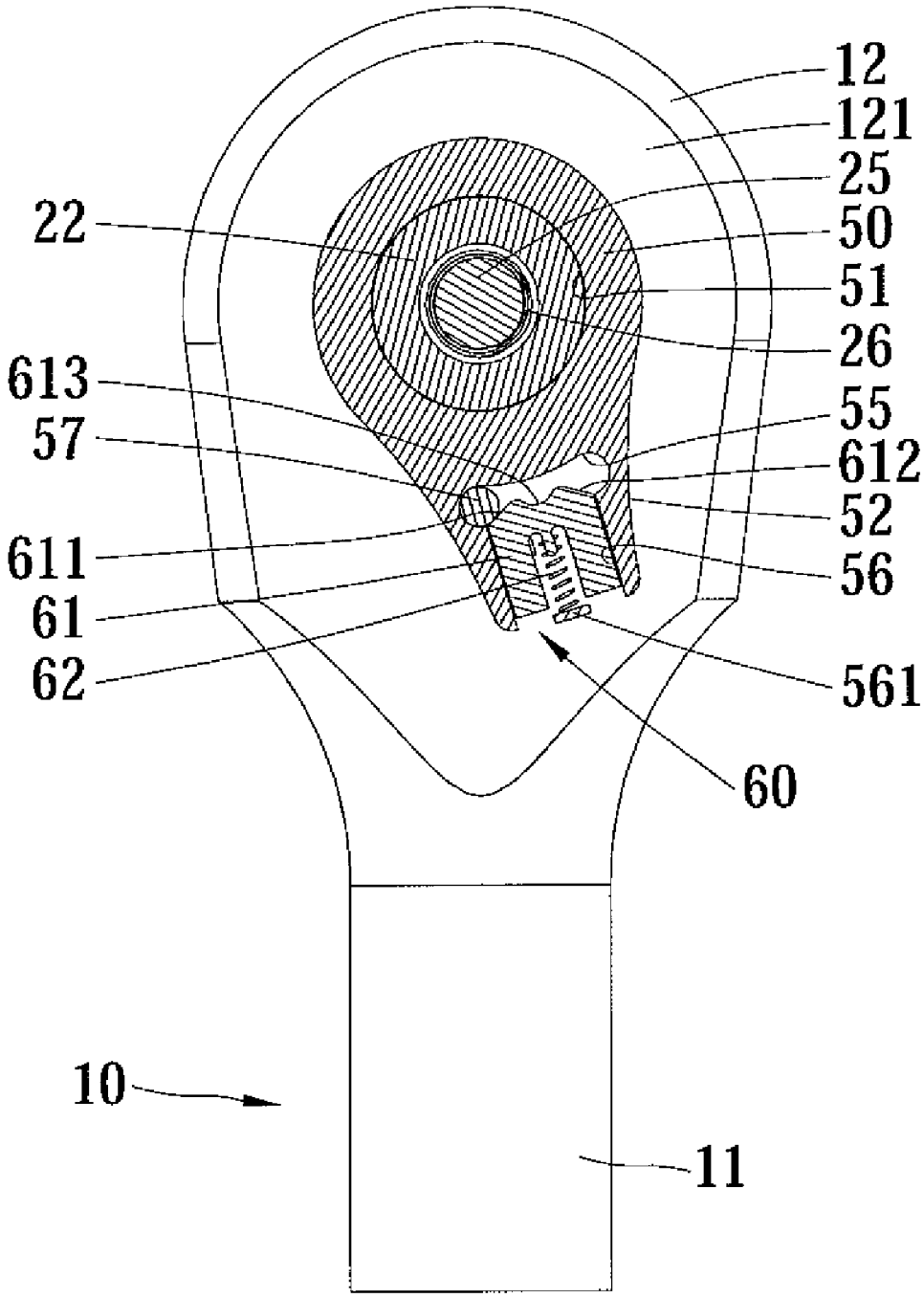
FIG. 6 shows a partial, cross sectional view similar to FIG. 4 with the reversing plate in a first operative position.
Figure 7:
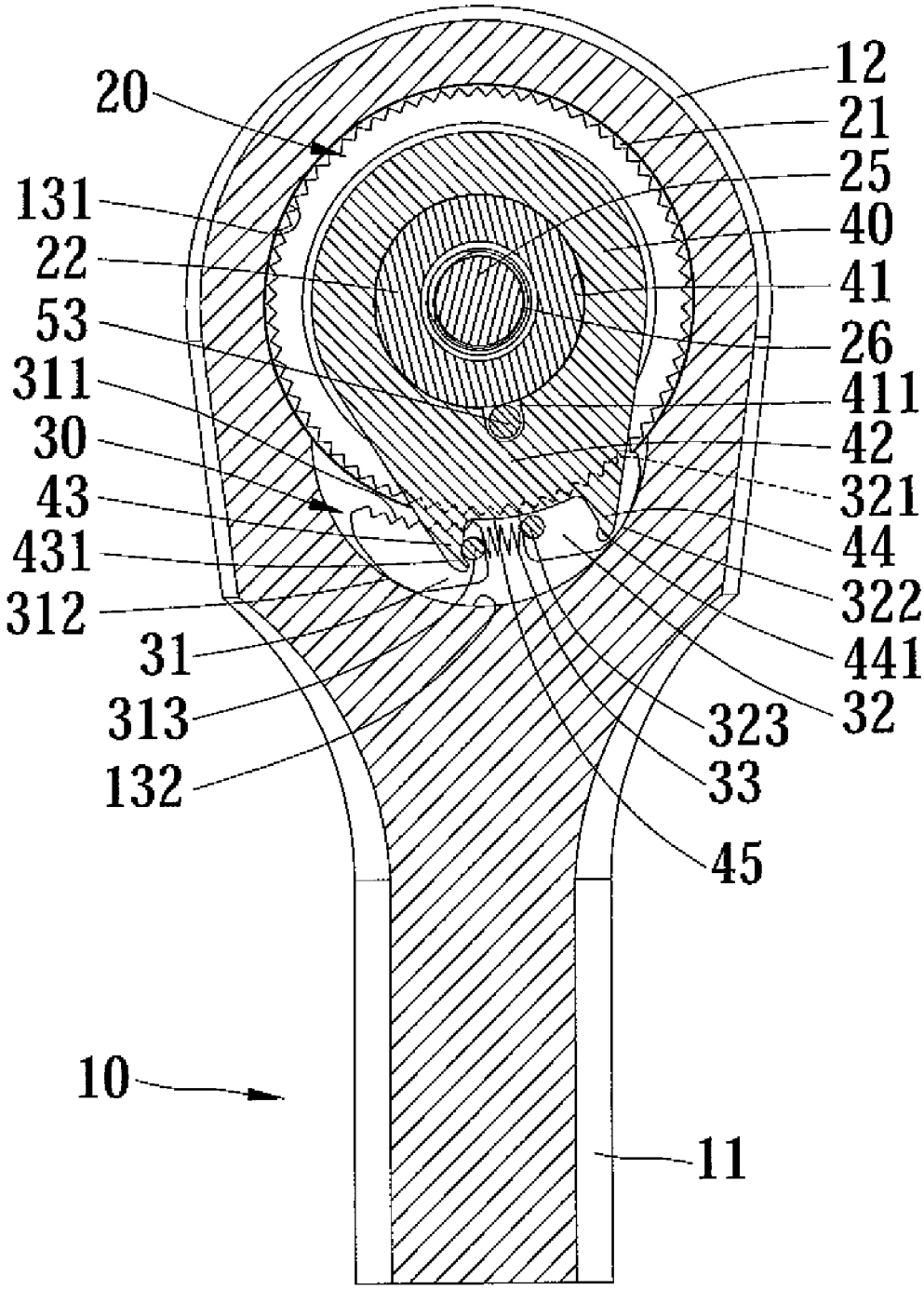
FIG. 7 shows a partial, cross sectional view similar to FIG. 5 with the ratchet wrench capable of driving a fastener in the clockwise direction.

When reversing plate 50 is pivoted from the third position to the first operative position (FIGS. 6 and 7), ring 40 pivots together with reversing plate 50 in the same direction. First push face 611 of slide piece 61 presses against pin 57 under action of elastic member 62 to reliably retain reversing plate 50 and ring 40 in place. Toothed face 321 of second pawl 32 is engaged with teeth 28 of drive member 20. First actuating portion 43 of ring 40 engages with first coupling portion 313 of first pawl 31 to disengage toothed face 311 of first pawl 31 from teeth 28 of drive member 20. Note that outer face 312 of first pawl 31 slides along the peripheral wall of second compartment section 132 when reversing plate 50 is moved from the third operative position to the first operative position. Elastic element 33 is compressed and exerts a force on first pawl 31 to push first pawl 31 away from second pawl 32. First coupling portion 313 of first pawl 31 presses 10 against first hooked portion 431 of first actuating portion 43 to assure reliable movement of first pawl 31 away from drive member 20 without interference. Note that first coupling portion 313 of first pawl 31 is engaged with and retained by first hooked portion 431 in space 45. In this state, handle 11 and drive member 20 can rotate in the clockwise direction to drive the fastener in the clockwise direction. Furthermore, handle 11 can rotate freely relative to drive member 20 in the counterclockwise direction without driving the fastener.

Figure 8:
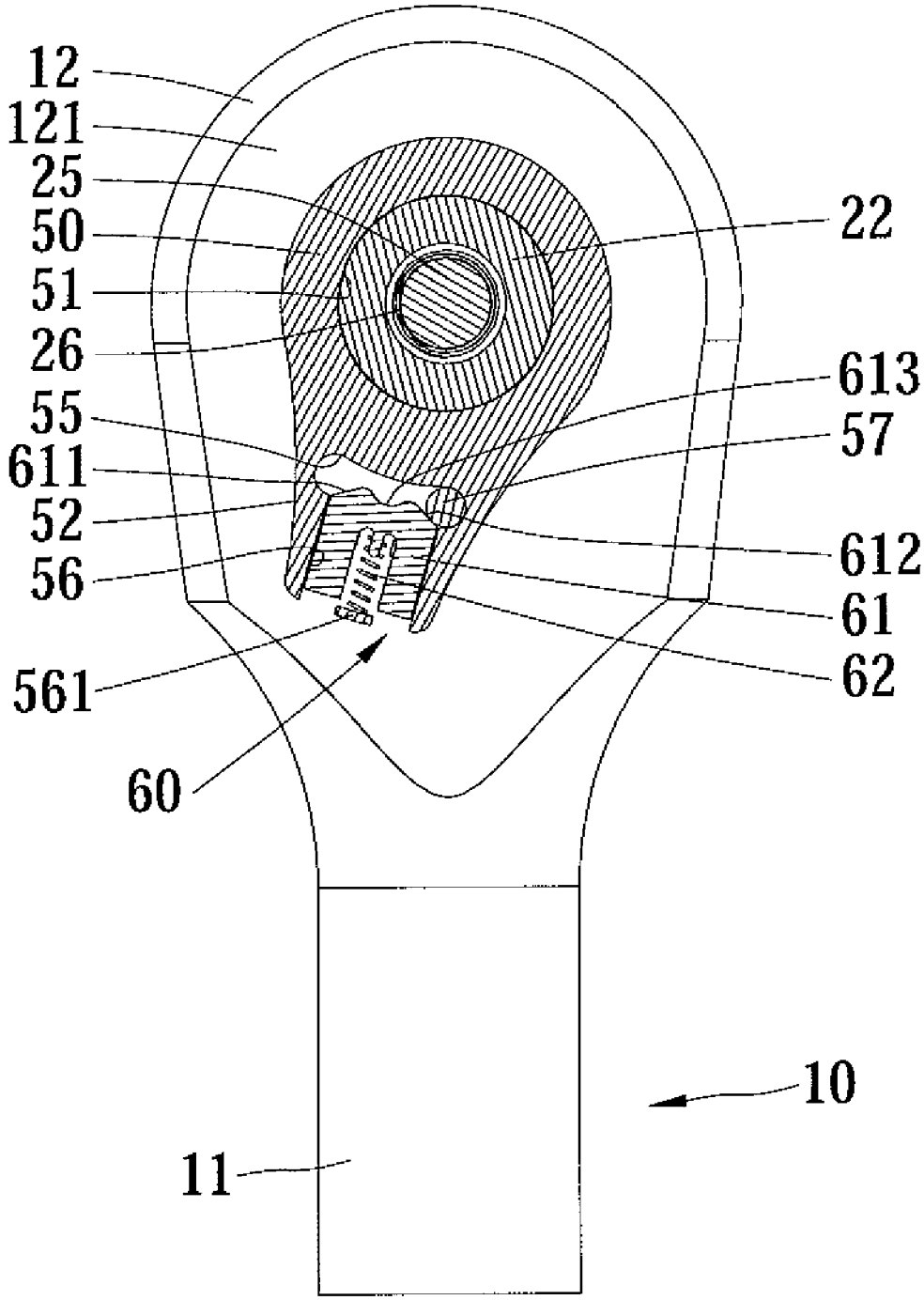
FIG. 8 shows a partial, cross sectional view similar to FIG. 4 with the reversing plate in a second operative position.
Figure 9:
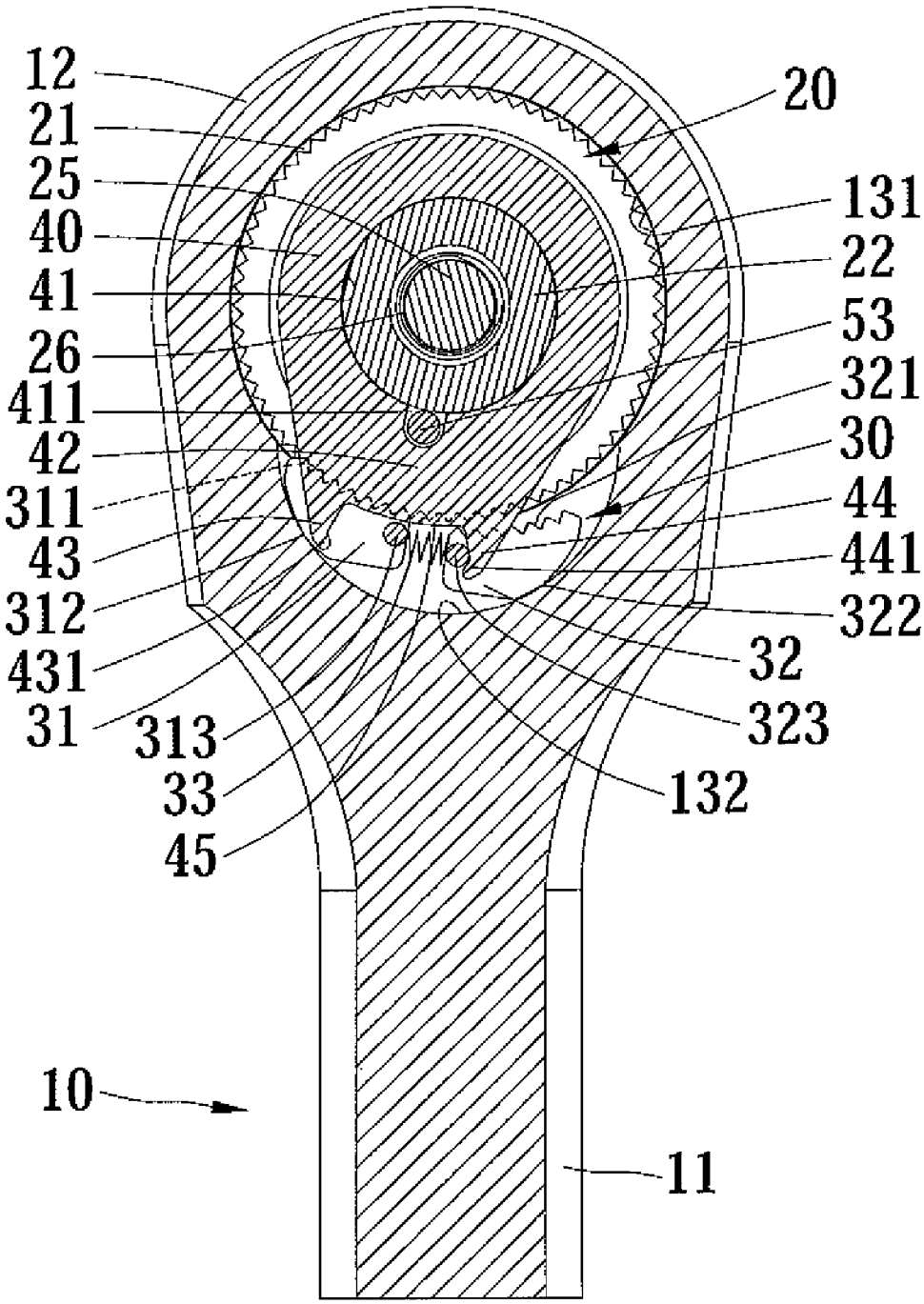
FIG. 9 shows a partial, cross sectional view similar to FIG. 5 with the ratchet wrench capable of driving a fastener in the counterclockwise direction.

When reversing plate 50 is pivoted from the third position to the second operative position (FIGS. 8 and 9), ring 40 pivots together with reversing plate 50 in the same direction. Second push face 612 of slide piece 61 presses against pin 57 under action of elastic member 62 to reliably retain reversing plate 50 and ring 40 in place. Toothed face 311 of first pawl 31 is engaged with teeth 28 of drive member 20. Second actuating portion 44 of ring 40 engages with second coupling portion 323 of second pawl 32 to disengage toothed face 321 of second pawl 32 from teeth 28 of drive member 20. Note that outer face 322 of second pawl 32 slides along the peripheral wall of second compartment section 132 when reversing plate 50 is moved from the third operative position to the second operative position. Elastic element 33 is compressed and exerts a force on second pawl 32 to push second pawl 32 away from first pawl 31. Second coupling portion 323 of second pawl 32 presses against second hooked portion 441 of second actuating portion 44 to assure reliable movement of second pawl 32 away from drive member 20 without interference. Note that second coupling portion 323 of second pawl 32 is engaged with and retained by second hooked portion 441 in space 45. In this state, handle 11 and drive member 20 can rotate in the counterclockwise direction to drive the fastener in the counterclockwise direction. Furthermore, handle 11 can rotate freely relative to drive member 20 in the clockwise direction without driving the fastener.

It can be appreciated that ring 40 and one of the first and second pawls 31 and 32 slide smoothly in the same direction while moving reversing plate 50 between the first, second, and third operative positions, the driving direction-switching operation is reliable. Furthermore, fewer elements are required in ratchet wrench 10 according to the preferred teachings of the present invention while providing an additional operative position as well as reliable positioning effect for the first, second, and third operative positions.

Now that the basic teachings of the present invention have been explained, many extensions and variations will be obvious to one having ordinary skill in the art. For example, first and second coupling portions 313 and 323 of first and second pawls 31 and 32 can be recessed portions or grooves. In this case, first and second actuating portions 43 and 44 can be in the form of protrusions extending into the recessed portions or grooves. Although drive column 23 in the preferred form shown is of the type capable of releasably engaging with a socket, other forms of drive column 23 for directly or indirectly driving a fastener would be within the skill of the art.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A ratchet wrench comprising, in combination:

a head and a handle interconnected to the head, with the head including a first side and a second side spaced from the first side, with the head further including a compartment defined between the first and second sides, with the compartment including a first compartment section and a second compartment section, with the first side having an opening in communication with the compartment;

a drive member rotatably received in the first compartment section, with the drive member including a coupling section at an intermediate portion thereof with an engaging portion extending from an end of the coupling section and having a portion beyond the head through the opening, with a drive column extending from another end of the coupling section beyond the head through the second side;

first and second pawls slideably received in the second compartment section, with each of the first and second pawls including a toothed face releasably engaged with the coupling section of the drive member, with an elastic element being mounted between the first and second pawls to bias the first and second pawls away from each other to engage the toothed faces of the first and second pawls with the coupling section of the drive member, with the first pawl including a first coupling portion, with the second pawl including a second coupling portion;

a ring received in the compartment and pivotably mounted around the engaging portion of the drive member about a pivot axis, with the ring including a tail extending toward the second compartment section, with the tail including first and second actuating portions respectively and releasably engaged with the first and second coupling portions of the first and second pawls;

a reversing plate pivotably mounted around the portion of the engaging portion beyond the head between first, second, and third operative positions about the pivot axis, with the reversing plate including a thumb piece for manually pivoting the reversing plate; and a retaining device received in the thumb piece, with the retaining device retaining the reversing plate in one of the first, second, and third operative positions while allowing movement of the reversing plate between the first, second, and third positions, wherein when the reversing plate is in the first operative position, the toothed face of the second pawl is engaged with the coupling section of the drive member, the first actuating portion of the ring is engaged with the first coupling portion of the first pawl to disengage the toothed face of the first pawl from the coupling section of the drive member, allowing the handle and the drive member to rotate in a first direction driving a fastener in the first direction, and allowing the handle to rotate freely relative to the drive member in a second direction reverse to the first direction without driving the fastener, wherein when the reversing plate is in the second operative position, the toothed face of the first pawl is engaged with the coupling section of the drive member, the second actuating portion of the ring is engaged with the second coupling portion of the second pawl to disengage the toothed face of the second pawl from the coupling section of the drive member, allowing the handle and the drive member to rotate in the second direction driving the fastener in the second direction, and allowing the handle to rotate freely relative to the drive member in the first direction without driving the fastener, and wherein when the reversing plate is in the third operative position, the toothed face of each of the first and second pawls is engaged with the coupling section of the drive member, allowing the handle and the drive member to rotate in either of the first and second directions driving the fastener, and not allowing free rotation of the handle relative to the drive member in either of the first and second directions without driving the fastener.

2. The ratchet wrench as claimed in claim 1, with the first and second actuating portions defining a space therebetween, and with the first and second coupling portions movably received in the space.

3. The ratchet wrench as claimed in claim 2, with the first actuating portion including a first hooked portion extending toward the second actuating portion, with the second actuating portion including a second hooked portion extending toward the first actuating portion, wherein when the reversing plate is in the first operative position, the first hooked portion is engaged with the first coupling portion of the first pawl to disengage the toothed face of the first pawl from the coupling section of the drive member, and the first coupling portion of the first pawl is retained in the space by the first hooked portion, wherein when the reversing plate is in the second operative position, the second hooked portion is engaged with the second coupling portion of the second pawl to disengage the toothed face of the second pawl from the coupling section of the drive member, and the second coupling portion of the second pawl is retained in the space by the second hooked portion, and wherein when the reversing plate is in the third operative position, the first and second coupling portions of the first and second pawls are disengaged from the first and second hooked portions.

4. The ratchet wrench as claimed in claim 1, with the opening including a first opening section coaxial with the first compartment section and a second opening section extending toward the handle, with the ring further including a notch, with the reversing plate further including a positioning peg extending through the second opening section and engaged in the notch, allowing joint pivotal movement of the reversing plate and the ring about the pivot axis.

5. The ratchet wrench as claimed in claim 1, with the thumb piece including an underside having an arcuate groove and a receiving space in communication with the arcuate groove, with the arcuate groove extending in a circumferential direction about the pivot axis, with the retaining device including a slide piece slideably received in the receiving space and extending into the arcuate groove, with the retaining device further including an elastic member, with the first side of the head including a pin hole intermediate the opening and the handle, with the ratchet wrench further comprising, in combination: a pin engaged in the pin hole and extending into the arcuate groove, with the arcuate groove slideably receiving the pin, and with the elastic member biasing the slide piece to press against the pin to retain the reversing plate and the ring in one of the first, second, and third operative positions.

6. The ratchet wrench as claimed in claim 5, with the slide piece having a longitudinal axis, with the slide piece including an outer side extending in a transverse direction transverse to the longitudinal direction, with the outer side having first, second, and third push faces, with the third push face intermediate the first and second push faces, with each of the first and second push faces being a slant at an acute angle with the longitudinal axis of the slide piece, with the third push face including an arcuate face defining a groove, and with the groove receiving the pin when the reversing plate is in the third operative position.

* * * * *